US007422477B2

(12) United States Patent
Eriksen

(10) Patent No.: US 7,422,477 B2
(45) Date of Patent: Sep. 9, 2008

(54) INSULATOR FOR COAXIAL CABLE CONNECTORS

(75) Inventor: Kim Eriksen, Praesto (DK)

(73) Assignee: John Mezzalingva Assoc., Inc., East Syracuse, NY (US)

( * ) Notice: Subject to any disclaimer, the term of this patent is extended or adjusted under 35 U.S.C. 154(b) by 0 days.

(21) Appl. No.: 11/999,187

(22) Filed: Dec. 4, 2007

(65) Prior Publication Data

US 2008/0132114 A1 Jun. 5, 2008

(30) Foreign Application Priority Data

Dec. 4, 2006 (DK) ..... 2006 01586

(51) Int. Cl.
*H01R 9/05* (2006.01)

(52) U.S. Cl. ..... 439/578; 439/584

(58) Field of Classification Search ..... 439/578, 439/584, 585

See application file for complete search history.

(56) References Cited

U.S. PATENT DOCUMENTS 3,761,870 A * 9/1973 Drezin et al. ..... 439/584
3,847,463 A * 11/1974 Hayward et al. ..... 439/578
4,346,958 A * 8/1982 Blanchard ..... 439/584
4,491,685 A * 1/1985 Drew et al. ..... 439/578
4,676,577 A * 6/1987 Szegda ..... 439/584
4,854,893 A * 8/1989 Morris ..... 439/578
4,923,412 A * 5/1990 Morris ..... 439/578
5,586,910 A 12/1996 Del Negro et al.
RE38,294 E 11/2003 Nattel et al.
2005/0272296 A1 12/2005 Laverick

* cited by examiner

*Primary Examiner*—Tho D Ta
(74) *Attorney, Agent, or Firm*—Melissa Bitting

(57) ABSTRACT

A connector for transferring high frequency signals comprises a connector body which is clamped together with a compression member, as well as a fastener member which is secured to the connector body. The connector body has a conductive pin with a center conductor seizing area for receiving the center conductor of a coaxial cable. An insulator is located within the connector body, the insulator having an insulator compression area configured to compress radially inwardly against the center conductor seizing area to secure the coaxial cable center conductor within the conductive pin.

13 Claims, 1 Drawing Sheet

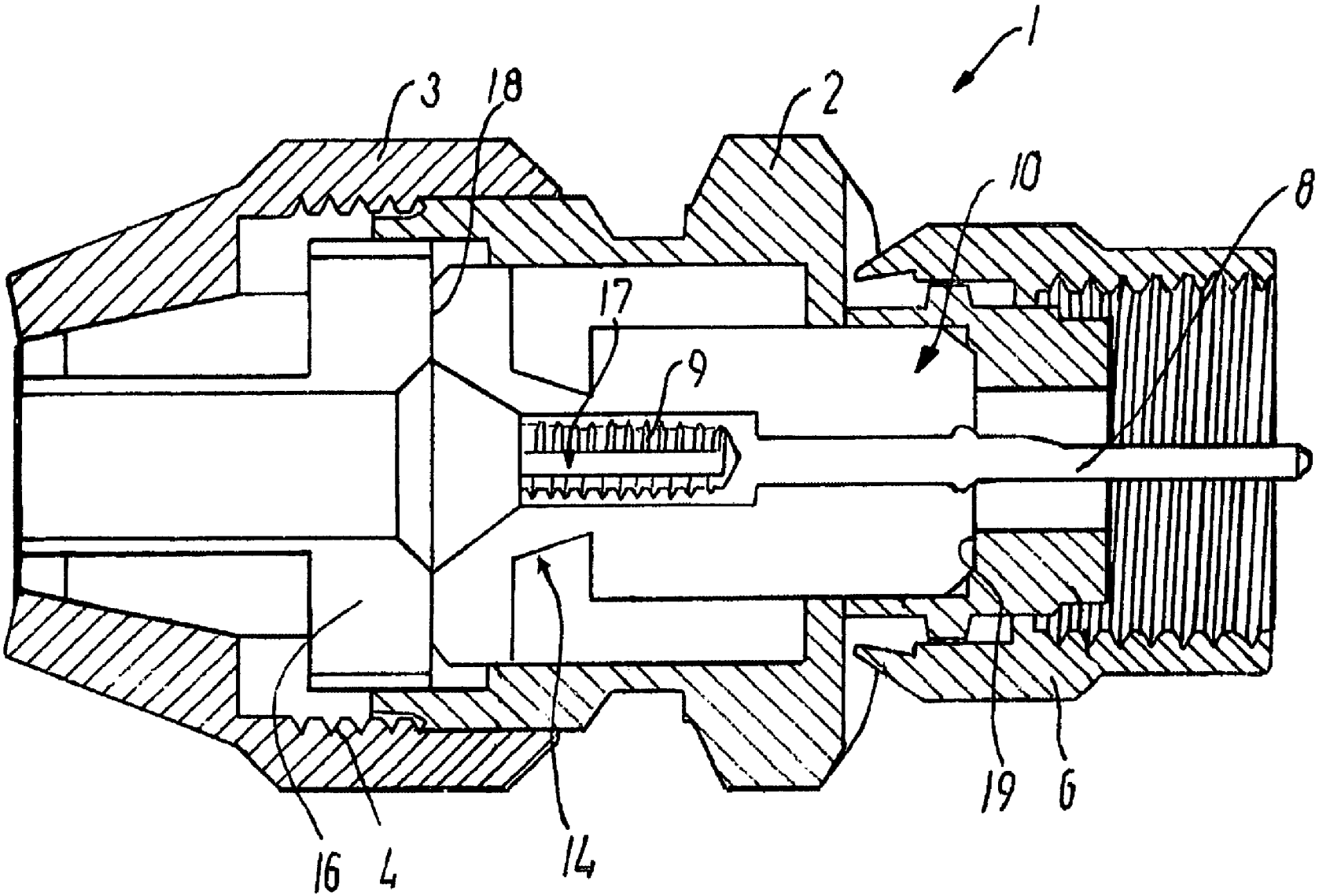
1
2
3
4
6
8
9
10
14
16
17
18
19

INSULATOR FOR COAXIAL CABLE CONNECTORS

FIELD OF THE INVENTION

The invention relates to coaxial cable connectors, and more specifically, to an improved insulator for a coaxial cable connector and a method of use thereof.

BACKGROUND OF THE INVENTION

The use of coaxial cable for video and data transfer is rapidly increasing. The ends of such coaxial cables must be connected to junction boxes, amplifiers, coaxial ports and the like and coaxial connectors are well known for terminating the ends of coaxial cables.

In order to properly transmit an electrical signal, a coaxial connector should ensure that a reliable electrical connection is achieved between the outer body of the connector and the outer conductor of the coaxial cable. Likewise, a suitable coaxial connector must achieve a reliable electrical connection between the conductive pin of the connector and the center conductor of the coaxial cable. In addition, reliable coaxial connectors must form a secure mechanical connection to the end of the coaxial cable, since mechanical separation of the connector from the end of the cable will interfere with successful transmission of the desired electrical signal.

Conductive pins typically have an internal passageway to receive the center conductor of the cable. The receiving portion of the conductive pin is surrounded by at least one clamp that secures the center conductor in the pin when a compression member is axially advanced within the connector body. However, these clamps add additional parts and expense to the coaxial cable connector.

It would be a great advantage to provide an improved coaxial cable connector that overcomes the above problems and disadvantages.

SUMMARY OF THE INVENTION

Accordingly, it is an object of the invention to provide a coaxial cable connector that consists of few parts but still allows a secure connection of the center conductor of the cable within the conductive pin.

The object of the invention is achieved by providing a coaxial cable connector that is characterized in that the conductive pin is partially disposed within an insulator and the insulator has an insulator compression area.

A further object of the invention is to provide an insulator compression area that is configured to compress radially inwardly against the conductive pin to secure the center conductor of the coaxial cable within the conductive pin.

Other objects and features of the invention will become apparent as the description proceeds, especially when taken in conjunction with the accompanying drawing illustrating the invention, of which there is one sheet.

DESCRIPTION OF THE DRAWINGS

FIG. 1 is cross-sectional view of an embodiment of a coaxial cable connector.

DESCRIPTION OF THE PREFERRED EMBODIMENT(S)

With reference to FIG. 1, an embodiment of coaxial cable connector 1 is shown prior to the installation of a coaxial cable. Connector 1 includes a connector body 2 with an internal passageway for receiving a coaxial cable (not shown). A fastener member 6 is connected to connector body 2 via an annular flange. An insulator 10 positions and holds a conductive pin 8 within connector body 2. Conductive pin 8 receives the center conductor of a coaxial cable upon insertion of the cable into connector 1 and establishes electrical conductivity between the center conductor and the mating port (not shown).

With further reference to FIG. 1, connector 1 includes a post 16 configured to receive the center conductor, dielectric and conductive foil of a coaxial cable (not shown). A conductive pin 8 is located within the internal passageway of connector body 2. Conductive pin 8 establishes electrical connection with the center conductor of the coaxial cable (not shown). Pin 8 includes a receiving area 17 for the center conductor of the coaxial cable. A center conductor seizing area 9 is configured to compress radially inwardly against the center conductor to secure the center conductor within pin 8. Center conductor seizing area 9 may be grooved, a grooved surface extending obliquely from the longitudinal axis, slotted or the like.

An insulator 10 is disposed within the internal passageway of connector 1 and partially surrounds conductive pin 8. Insulator 10 has an insulator compression area 14 configured to compress radially inwardly against the center conductor seizing area 9 to secure the center conductor within pin 8 as the compression member 3 is axially advanced along a longitudinal axis. Insulator compression area 14 may be an area of narrow cross-section, a grooved surface, a frustoconical surface or the like.

As the prepared end of a coaxial cable (not shown) is inserted into the internal passageway of the connector 1, the center conductor of the coaxial cable is inserted into the center conductor receiving area 17 of conductive pin 8. Compression member 3 is then axially advanced along the longitudinal axis. Axial advancement may occur through the use of threads 4 as shown in FIG. 1. Axial advancement of compression member 3 causes axial advancement of post 16 against the first end 18 of insulator 10 and causes insulator 10 to engage a shoulder 19 of connector body 2. Further axial advancement causes the insulator compression area 14 to compress the center conductor seizing area 9 radially inwardly to secure the center conductor within the conductive pin 8.

While I have illustrated and described preferred embodiments of my invention, it is understood that this is capable of modifications, and I therefore do not wish to be limited to precise details set forth, but desire to avail myself of such changes and alterations as fall within the purview of the following claims.

I claim:

1. A coaxial cable connector comprising:

a connector body having a first connector body end and a second connector body end, the connector body extending along a longitudinal axis, the connector body having an internal passageway defined therein, a fastener member attached proximate the second connector body end;

a conductive pin partially disposed within the connector body internal passageway, a portion of the conductive pin configured to receive and seize a center conductor of a coaxial cable;

an insulator disposed within the connector body, the insulator surrounding a portion of the conductive pin, the insulator having a first insulator end and a second insulator end, the insulator further having an insulator compression area surrounding a portion of the conductive pin; and, a compression member attached to the first connector body end, a post partially disposed within the compression member, wherein axial advancement of the compression member causes the post to engage the first insulator end and the second insulator end to engage a shoulder within the connector body internal passageway to place the insulator in a fixed position with respect to the longitudinal axis, wherein further axial advancement of the compression member causes the insulator compression are to compress radially inwardly against the conductive pin to seize the outer conductor within the conductive pin.

2. A connector according to claim 1, wherein the insulator compression area is configured to have a narrow cross-section.

3. A connector according to claim 1, wherein the insulator compression area is configured as a grooved surface.

4. A connector according to claim 3, wherein the grooved surface extends obliquely from the longitudinal axis.

5. A method of attaching a coaxial cable connector to a coaxial cable, the coaxial cable having a center conductor, the connector comprising: a connector body having an internal passageway disposed therein, the connector body extending along a longitudinal axis, a conductive pin partially disposed within the internal passageway, an insulator disposed within the internal passageway and surrounding a portion of the conductive pin, a compression member attached to one end of the connector body, a post partially disposed within the compression member, the method comprising the steps of:

inserting a prepared end of the coaxial cable into the connector while substantially simultaneously inserting the center conductor into the conductive pin;

axially advancing the compression member along the longitudinal axis of the connector body, whereby axial advancement of the compression member causes the post to engage the insulator and the insulator to engage a shoulder within the connector body, placing the insulator in a fixed position with respect to the longitudinal axis, wherein further axial advancement of the compression member causes a portion of the insulator to compress radially inwardly against a center conductor seizing area of the conductive pin to secure the center conductor within the conductive pin.

6. The method of claim 5, wherein the portion of the insulator that compresses radially inwardly against a center conductor seizing area is configured to have a narrow cross-section.

7. The method of claim 5, wherein the portion of the insulator that compresses radially inwardly against a center conductor seizing area is configured as a grooved surface.

8. The method of claim 7, wherein the grooved surface extends obliquely from the longitudinal axis.

9. A coaxial cable connector comprising:

a connector body having a first connector body end and a second connector body end, the connector body extending along a longitudinal axis and having an internal passageway defined therein;

a fastener member configured to engage the second connector body end;

an insulator disposed within the internal passageway, the insulator in a fixed position with respect to the longitudinal axis, the insulator having an insulator compression area;

a conductive pin partially disposed within the insulator, the conductive pin having a center conductor seizing area configured to receive a center conductor of a coaxial cable; and, a compression member configured to engage the first connector body end, wherein axial advancement of the compression member along the connector body longitudinal axis causes the insulator compression area to compress radially inwardly against the center conductor seizing area to secure the center conductor within the conductive pin.

10. A connector according to claim 9, wherein the insulator compression area is configured to have a narrow cross-section.

11. A connector according to claim 9, wherein a first end of the insulator engages an inner post within the compression member and a second end of the insulator engages a shoulder within the connector body.

12. A connector according to claim 9, wherein the insulator compression area is configured as a grooved surface.

13. A connector according to claim 12, wherein the grooved surface extends obliquely from the longitudinal axis.

* * * * *